United States Patent [19]

Focke et al.

[11] Patent Number: 4,570,414

[45] Date of Patent: Feb. 18, 1986

[54] APPARATUS FOR CLOSING AND TRANSPORTING AWAY ESPECIALLY POUCH PACKS

[75] Inventors: Heinz Focke; Oskar Balmer, both of Verden, Fed. Rep. of Germany

[73] Assignee: Focke & Co., Fed. Rep. of Germany

[21] Appl. No.: 421,616

[22] Filed: Sep. 22, 1982

[30] Foreign Application Priority Data

Jun. 11, 1982 [DE] Fed. Rep. of Germany ..... 3222102

[51] Int. Cl.[4] ..... B65B 51/30

[52] U.S. Cl. ..... 53/373; 156/538; 198/339.1; 198/447

[58] Field of Search ..... 53/236, 251, 252, 371, 53/373, 477, 574, 575; 198/436, 447, 448, 451, 339; 156/538, 566

[56] References Cited

U.S. PATENT DOCUMENTS

| | | | |
|---|---|---|---|
| 3,520,106 | 7/1970 | Aalpoel | 53/373 |
| 3,924,386 | 12/1975 | Schmermund | 53/236 |
| 4,085,568 | 4/1978 | Focke et al. | 53/371 |

*Primary Examiner*—Robert L. Spruill

*Assistant Examiner*—Richard M. Mudd

*Attorney, Agent, or Firm*—Sughrue, Mion, Zinn, Macpeak & Seas

[57] ABSTRACT

An apparatus for closing and transporting tobacco pouches includes a turret type feed conveyor, a reciprocating preconveyor and a pocket-chain type discharge conveyor. Closing apparatus are associated with the pre-conveyor. A tobacco pouch is transported from the feed conveyor to one of a plurality of movable pack receptacle regions at a feed station, and then transported, by reciprocating fingers, to a discharge station where closing apparatus seals the pouch. The sealed pouch is thereafter discharged to a pocket of the discharge conveyor. Each discharge station is provided with a pair of spaced, movable walls which receive a pouch therebetween, retain the pouch during sealing and are thereafter moved to carry the sealed pouch to the discharge conveyor. Finger retraction and extension apparatus are provided to move the fingers into engagement with a pouch at the feed station and to disengage the fingers from a pouch at the discharge station.

14 Claims, 11 Drawing Figures

(VII-VII)

(XI)

APPARATUS FOR CLOSING AND TRANSPORTING AWAY ESPECIALLY POUCH PACKS

BACKGROUND OF THE INVENTION

The invention relates to an apparatus for closing and transporting filled tobacco pouches by means of a discharge conveyor, in which apparatus at least one pouch opening is to be sealed by suitable sealing means such as welding or gluing means.

To achieve maximum performance of packaging machines, it is important for all operating regions of the machine to be synchronized. Bottlenecks which can arise, for example, in the region where pouches are sealed, must be prevented. Such a bottleneck is likely to occur at the pouch-sealing region of a high performance apparatus when pouch-closing tabs are to be sealed together by thermal welding or gluing. The pouch which is largely completed after this sealing operation is then conventionally transferred to a discharge conveyor for further transport.

The invention is concerned with the above-mentioned problem, specifically to the production and sealing of tobacco pouches.

SUMMARY OF THE INVENTION

An object of the invention is to develop an apparatus of the type described hereinbefore in which no delays occur in the apparatus work cycle. This, in practice, requires an apparatus designed to compensate for the relatively long time period needed for the sealing.

To achieve this object, the apparatus according to the invention is characterized in that the filled pouches are introduced into a pre-conveyor with at least two pack receptacles, one of which serves to receive and retain a pouch while the other is transferring another pouch to the discharge conveyor, the pouches being sealed during their stay in the pre-conveyor.

The discharge conveyor is designed as a pocket chain, with a plurality of specially designed pockets for receiving and transporting pouches in a fixed time sequence.

The pre-conveyor with at least two pack receptacles allows several packaging operations to take place simultaneously. During the time when one pouch is introduced into the pre-conveyor, another processing operation, namely closing and thermal welding or sealing or gluing, is carried out on another pouch within the region of the pre-conveyor. During the time when the pre-conveyor is at a standstill, the closed pouch is transferred to the discharge conveyor. The predetermined work cycle, which includes discharge conveyor movement, the receipt of pouches in the pre-conveyor and the movement of the pre-conveyor, can be synchronized with the productive capacity of the machines located in front and behind. Because two or more pouches are "processed" approximately at the same time in the region of the pre-conveyor, delays which otherwise occur are avoided.

According to the invention, the pre-conveyor is located above and is movable to and fro along the longitudinal axis of the discharge conveyor. The arrangement is such that each of the pack receptacles is about the same size as the pockets of the discharge conveyor and are each positioned exactly above an associated pocket.

The actual closing (welding, sealing or the like) of pouch closing tabs takes place in the region of the pack receptacle where the pouch is subsequently transferred to the discharge conveyor pocket located under it. The other pack receptacle serves at this time to receive a filled but still open pouch.

In a preferred embodiment, the pre-conveyor consists of two connected pack receptacles. While one of the two pack receptacles is receiving a pouch the other pack receptacle, located in front or behind the one receptacle in the direction of transport of the discharge conveyor, functions to seal the pouch contained therein and for other functions to be described. Welding or sealing tools, especially sealing tongs, are located in the regions where pouch sealing is to take place.

According to a further feature of the invention, the pack receptacles consist of vertically movable retaining members positioned in the plane above the pre-conveyor. These members are interconnected in such a way that their movement is mechanically controlled by the drive of the pre-conveyor or by cam discs.

BRIEF DESCRIPTION OF THE DRAWINGS

Further details of the invention are explained in more detail below with reference to the embodiment illustrated in the drawings in which.

DETAILED DESCRIPTION OF THE PREFERRED EMBODIMENT

Figure 1:
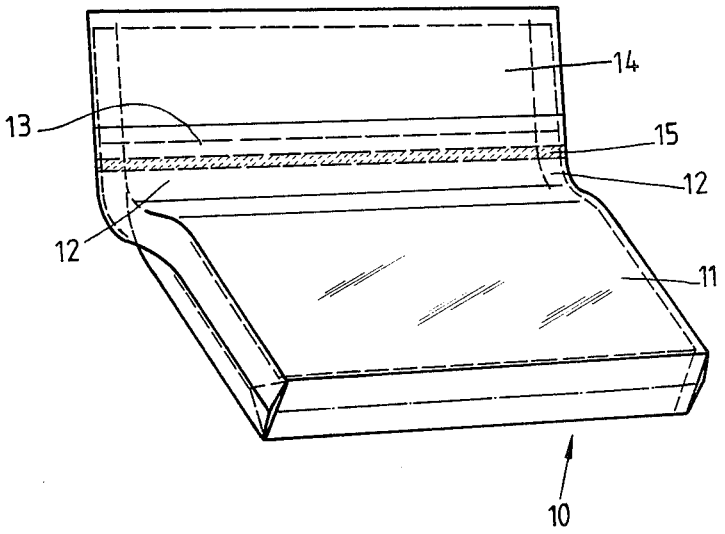
FIG. 1 shows a tobacco pouch pack.
Figure 2:
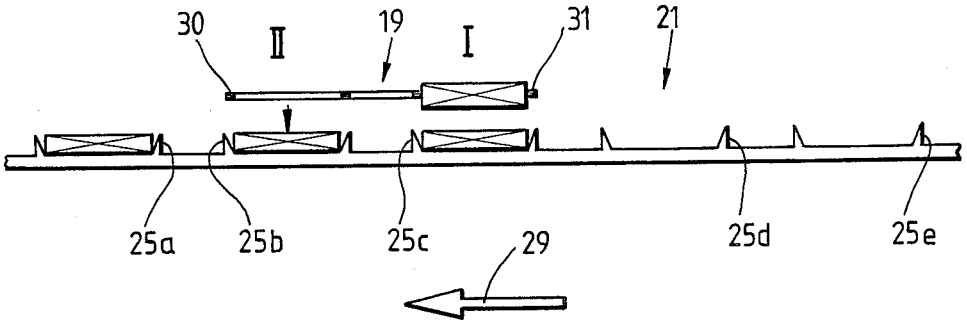
FIG. 2 to FIG. 5 show, in a greatly simplified representation, a pre-conveyor and a discharge conveyor in various positions.

The packaging machine embodiment shown relates to tobacco pouches 10. A pouch of this type consists of a pouch body 11 for receiving the tobacco and of adjoining tabs in the region of an opening 12, namely a gripping tab 13 and covering tab 14. These are elongations of foils forming the pouch body 11. The gripping and covering tabs are connected to one another in the region of the opening 12 by a sealing seam 15, such as by welding or gluing. The sealed gripping and covering tabs 13, 14 are then folded over against the front side of the pouch body 11 and fastened thereto.

Figure 6:
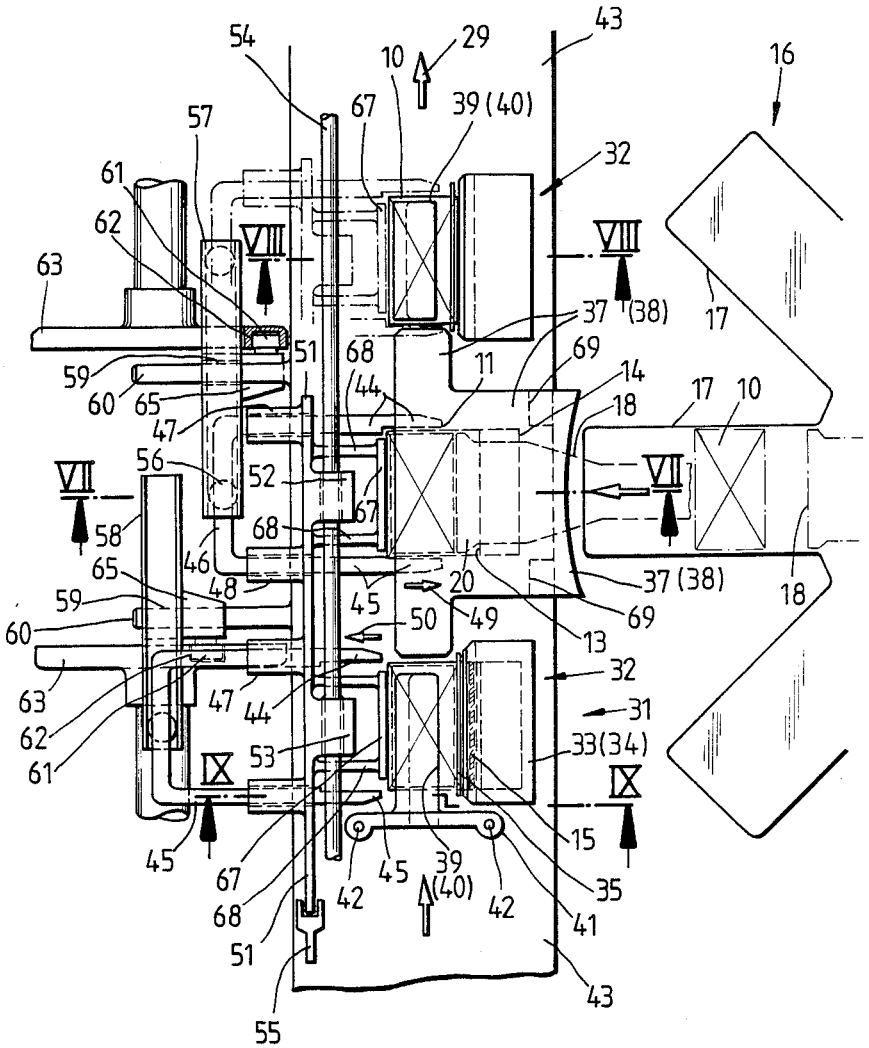
FIG. 6 shows the entire apparatus of the invention in a simplified plan view.

In the present embodiment a pouch 10 of this type is filled with tobacco in a suitable packaging unit, shown diagrammatically in FIG. 6 as a filling turret 16 revolving at a fixed rate. From turret pockets 17 a particular pouch 10 is ejected by a reciprocating radial slide 18 into a pre-conveyor 19. The arrangement is such that the pouch body 11 within the filling turret 16 points outwardly in a radial direction. The longer covering tab 14 extends in the lower plane. The gripping tab 13 and covering tab 14 each extend as elongations of the associated front and rear walls of the pouch body 11. A head 20 of the slide 18 penetrates into the pouch body and thus comes to rest directly against the filled tobacco. In this position the pouch 10 is transferred from the turret 16 to the pre-conveyor 19.

Figure 10:
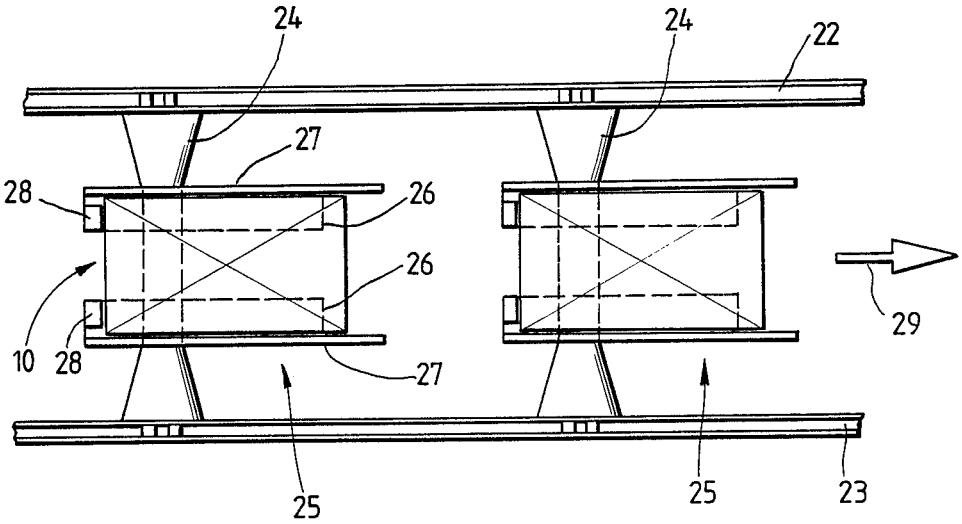
FIG. 10 shows in a plan view an embodiment of the discharge conveyor.

The pre-conveyor 19 serves to periodically receive the pouches 10 and to transfer them to a discharge conveyor 21 designed as a pocketed chain. Between lateral transport chains 22, 23 there extend transversely directed planar cross members 24 connecting the chains to one another. Attached approximately in the center to each of these cross members is a pocket 25 for receiving a pouch 10. The pockets 25 rest off-center in relation to the cross members 24 to guarantee a balanced mounting, and consist of lateral horizontal support legs 26 on which the pouches rest, and adjoining vertical side walls 27. The rear ends of the support legs 26 in the direction of transport are provided with vertical limitations 28 which serve as a rear rest for the pouches. The pockets 25 are thus open at the front in the direction of transport and at the top, as shown in FIG. 10.

The pre-conveyor 19 is located above the discharge conveyor 21 and is movable to and fro in the direction of transport of the discharge conveyor 21 (arrow 29) or in the opposite direction. The pre-conveyor has two pack receptacles 30, 31 which are moved together as described above. Each pack receptacle is assigned to a pouch. The relative movements of the pre-conveyor 19 are such that when it is at a standstill one of the pack receptacles 30 or 31 is located in a feed station I opposite the emptying turret pocket 17 so that a filled pouch 10 can be introduced into the receptacle by the slide 18.

The sequential positions of the pre-conveyor 19 and of the discharge conveyor 21 in operation are shown diagrammatically in FIGS. 2 to 5. The pocket 25*a* of the discharge conveyor, which is located at the front in the direction of transport, is already supplied with a sealed pouch. The following pocket 25*b* is located underneath the pack receptacle 30 of the pre-conveyor 19. The dimensions and relative position are such that a downward movement of the pouch 10 transfers it from the receptacle 30 into the pocket 25*b* of the discharge conveyor 21 located under it. At approximately the same time as such transfer at station II, the pack receptacle 31 of the pre-conveyor is supplied with a further pouch at station I.

Figure 3:
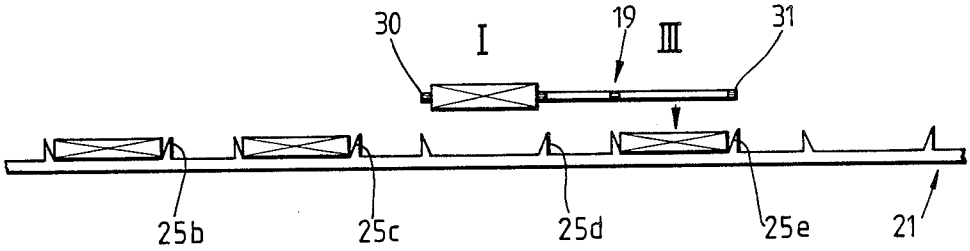
Figure 4:
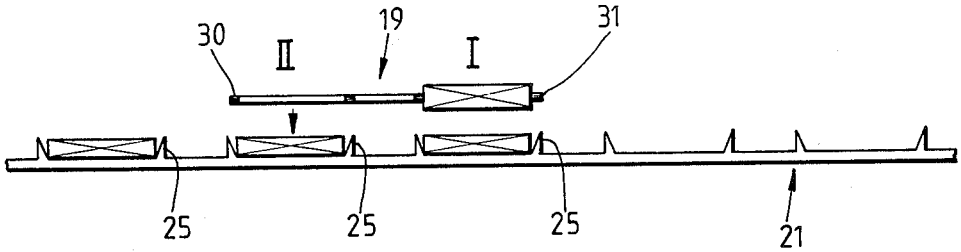
Figure 5:
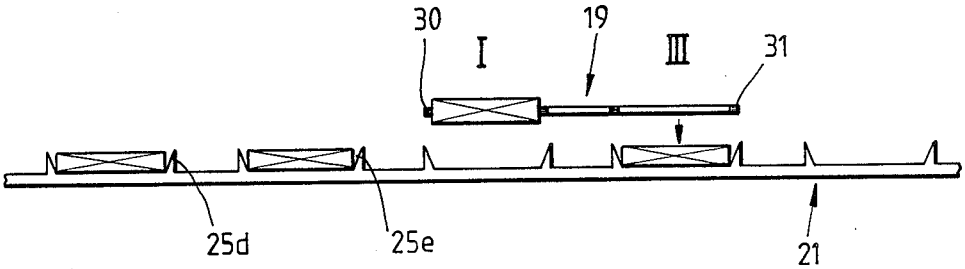

An oppositely directed movement of the pre-conveyor 19 then takes place, as seen in FIG. 3. The pouch in the receptacle 31 is transferred into the pocket 25*e* by a downward movement at station III. As may be seen by comparing FIGS. 2 and 3, during the oppositely directed movement of the pre-conveyor 19 the discharge conveyor 21 has likewise been moved further a fixed amount in the customary conveying direction, so that there is a "jump" in relation to the pocket 25*d* still to be supplied.

During this stage a pouch 10 is introduced into the receptacle 30. During the further movement of both the pre-conveyor 19 and the discharge conveyor 21 in the same direction (FIG. 4), the receptacle 30 and pocket 25*d* move into the region of station II, so that the operation already described can be repeated.

This back and forth switching of the pre-conveyor 19 makes it possible to carry out time-consuming operations on the pouches 10 before they are transported away by the discharge conveyor 21, specifically while maintaining a short machine cycle. In particular, during this intermediate conveying stage the pouches are closed by the welding or sealing of the gripping and covering tabs 13, 14. The apparatus can be controlled so that 75 machine cycles per minute are executed. Within such a machine cycle the discharge conveyor 21 is stopped during a stage of 120° and is otherwise in motion over 240°. The switching cycle of the pre-conveyor 19 can be 130°, and the movements of the pre-conveyor and the discharge conveyor can start at the same time. In the present case, the discharge conveyor 21 is moved at a correspondingly higher speed.

A closing tool is assigned to stations II and III, namely sealing tongs 32 with upper and lower jaws 33, 34. These extend in the direction of transport of the pouches within the pre-conveyor 19. Because of their relative position the gripping and covering tabs 13, 14 extending along the side of the sealing tongs 32 are conveyed into the region between the opened jaws 33, 34 at station II or III. The sealing tongs 32 are then closed to form the seam 15. After the tongs have been opened, the sealed pouch is moved downwards into the pocket 25 located under it.

Figure 9:
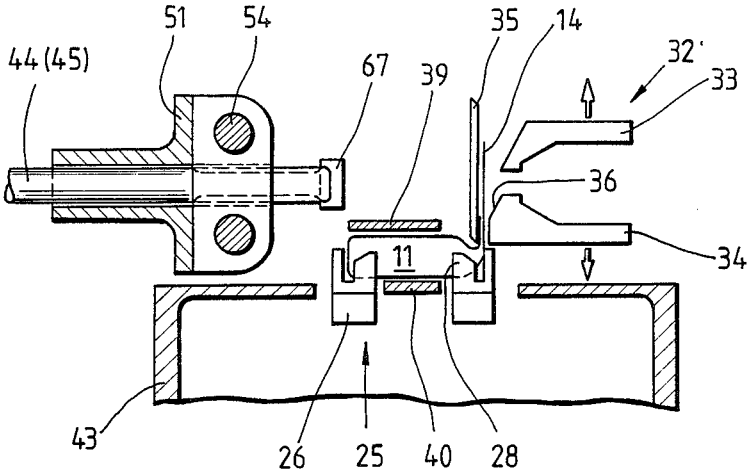
FIG. 9 shows in cross-section the portion of the apparatus shown in FIG. 8, moved to a different position.

During this downward movement the covering and gripping tabs 13, 14 are moved into a vertical position as shown in FIG. 9, by means of a folding blade 35 which moves downward against the pouch 10 in the region of the seam 15. Since during the downward movement, the pouch is moved along on a fixed counter-folder, the covering and gripping tabs are folded upright. The fixed counter-folder is formed by the lower sealing jaw 34 which, on the side facing the pouch, is made with a sloping face 36 and is located immediately adjacent the path of movement of the blade 35. The upright position of the tabs is maintained in the pocket 25 of the discharge conveyor by the side wall 27.

The pack receptacles 30 and 31 of the pre-conveyor 19 consist of stationary as well as vertically and horizontally movable parts.

Figure 7:
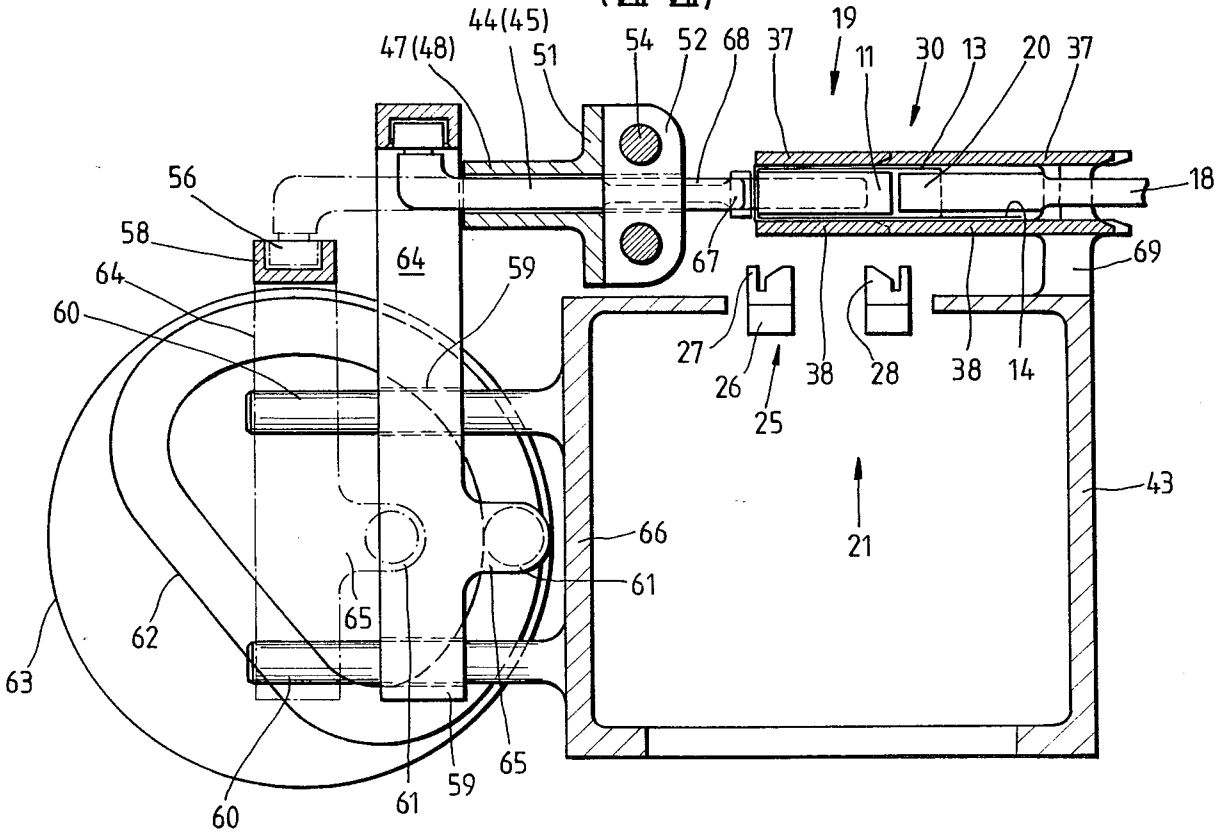
FIG. 7 shows a cross-section VII—VII of FIG. 6 on an enlarged scale.
Figure 8:
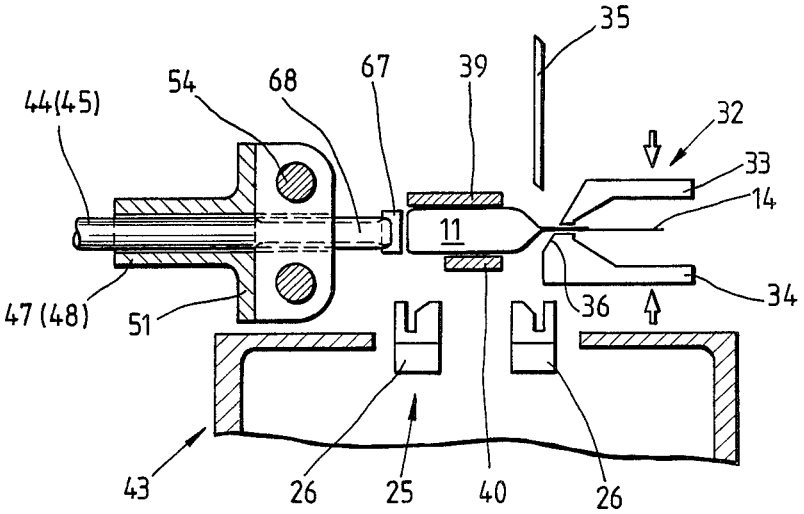
FIG. 8 shows a portion of the apparatus as illustrated in FIG. 7, located in the region of another station.

Each station I, II, III is provided, for cooperation with the pack receptacles 30, 31, with an upper wall 37 or 39 and a lower wall 38 or 40. The upper wall 37 and lower wall 38 are arranged in the region of the feed station I, and are supported by lateral struts 69 on a housing 43 of the discharge conveyor 21. The distance between the upper wall 37 and lower wall 38 is such that the pouch body 11 of the pouch 10 can be pushed between the upper wall 37 and the lower wall 38 by the slide 18 as seen in FIG. 7. Therefore, after being pushed out of the filling turret 16, the pouches, guided by the upper wall 37 and lower wall 38, can be transferred into the pack receptacle at the feed station I.

The upper wall 37 and lower wall 38 also extend into the stations II or III to guide the pouches from feed station I to transport station II or III. The pouch leaves the confines of the upper wall 37 and lower wall 38 at station II or III where it is received in the space between the upper wall 39 and lower wall 40.

The upper wall 39 and lower wall 40 are vertically movable to lower the pouch retained by walls 39, 40 onto a pocket 25. The lower wall 40 is of a width which permits it to penetrate the region between ajacent supporting legs 26 of the pocket 25 to thereby cause the pouch to be deposited in the pocket as walls 39, 40 are lowered. The pouch 10 is now conveyed away by the pocket 25 from the region between the upper wall 39 and lower wall 40.

Figure 11:
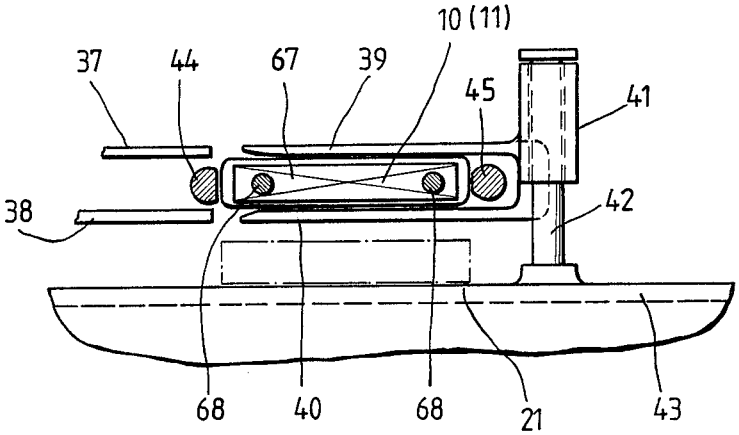
FIG. 11 shows a detail of the apparatus illustrated in FIG. 6.

As is evident from FIG. 11, the upper wall 39 and lower wall 40 are connected to one another in such a way that an essentially U-shaped cross-sectional profile is obtained. The walls 39, 40 are slidably mounted on lateral supporting columns 42 via a driven guide sleeve 41. A pressure cylinder or piston connected to the guide sleeve 41 may be used to provide the guide sleeve drive. The supporting columns 42 are located on a fixed housing 43 of the discharge conveyor 21.

For transporting the pouches 10 from the station I into the station II or III there are provided fingers 44, 45 which engage the narrow side faces of the pouches. These fingers are movable in the conveying direction and also transversely thereto to thereby move the pouches between stations and downwardly to the pockets 25.

In the embodiment being described, the fingers 44, 45 are connected to one another by a cross-web 46 to form a U-shaped structure. This structure is mounted to slide in supporting sleeves 47, 48, which guide finger movement in the direction of arrows 49, 50.

The supporting sleeves 47 and 48 are part of a common holder 51 extending essentially in the conveying direction. Lateral bearing sleeves 52, 53 support and guide the holder 51 on two vertically parallel support rods 54 as illustrated in FIGS. 6–9. The holder 51 is reciprocally driven by a suitable driving mechanism through rod 55.

To move fingers 44, 45 between the feed and transfer stations there is provided a guide roller 56 mounted in the region of the cross-web 46 of each finger pair. The guide roller penetrates into a guide rail 57 or 58. A guide rail 57, 58 is assigned to each park receptacle. The length of this guide rail in the direction of movement is calculated so that the guide roller 56 can move in the guide rail between the feed station I and a transfer station II or III.

Formed on the guide rails are bearing sleeves 59 mounted to slide on two fixed supporting journals 60. These are attached, transversely to the direction of movement of pouch 10, to a side wall 66 of the housing 43 whereby the guide rails can be moved in the direction transverse to the direction of pouch movement. As a result, the fingers 44, 45 are either retracted from or extended into the path of the pouch 10.

For controlling the movement of a guide rail 57, 58 together with its associated fingers 44, 45, a supporting roller 61 is attached to the supporting journal 60 of the guide rail as shown in FIG. 6. These penetrate into a curved groove 62 in a cam disc 63 driven to rotate as shown in FIG. 7. As a result, the above-described to-and-fro drive of the fingers 44, 45 is made possible.

As is evident from FIG. 7, in the present embodiment, the guide rails 57, 58 are open on opposite sides, so that the guide rollers 56 penetrate into the guide rails 57, 58 from below in one case and from above in the other case.

On the underside of these are formed the retaining sleeves 59 in the supporting legs 64, which serve to overcome the height difference and to which the supporting rollers 61 are attached laterally by means of an extension 65.

The pack receptacles 30, 31 are provided, on the side located opposite the infeed side in the region of the feed station I (opposite the slide 18) with a limitation or guide for the pouch pack 10. As is evident from FIG. 6, this guide is in the form of a supporting wall 67 which determines the position of the pouch pack 10 in the pack receptacle 30, 31. The supporting wall 67, as a fixed component of the holder 51 of the pack receptacle 30, 31, is movable together with the holder in the conveying direction (arrow 29). The supporting walls 67 are connected to the common holder 51 via webs 68 which extend on both sides of the bearing sleeves 52 and 53.

The closed pouch packs 10 transferred to the discharge conveyor 21 are there completed by folding over the covering tab 14 together with the gripping tab 13 and by attaching thereto a closing strip or the like.

What is claimed is:

1. An apparatus for transporting pouches comprising:

(a) feed conveyor means (16) for transporting pouches to a pre-conveyor means;

(b) pre-conveyor means (19) for receiving pouches from said feed conveyor means, and for transporting said received pouches to a discharge conveyor means, said pre-conveyor means including means for operating on pouches (32, 33, 34) while in said pre-conveyor means, (c) wherein said pre-conveyor means (19) comprises a plurality of pack receptacle regions (30, 31), one of said pack receptacle regions being positioned at a feed station to receive pouches from said feed conveyor means (16) while another of said pack receptacle regions is simultaneously positioned at a discharge station to permit transfer of a pouch therein to the discharge conveyor means to thereby enable said pre-conveyor to transport a pouch from one of its pack receptacle regions to said discharge conveyor means while a pouch is received by another pack receptacle positioned at said feed station from said feed conveyor means, (d) at least first and second discharge stations, and means for reciprocating each said one and said another of said pack receptacle regions between said feed station and one of said discharge stations, and (e) discharge conveyor means (21) for receiving pouches from said pre-conveyor means and transporting the received pouches for further processings.

2. The apparatus for transporting pouches as claimed in claim 1, wherein said means for operating on pouches comprises sealing means.

3. The apparatus for transporting pouches as claimed in claim 2, wherein said sealing means comprises sealing tongs (32) with upper and lower sealing jaws (33, 34).

4. The apparatus for transporting pouches as claimed in claim 1, wherein said means for operating on said pouches are located at said discharge station.

5. The apparatus for transporting pouches as claimed in claim 1, wherein said means for operating on said pouches are located at said first and second discharge stations.

6. The apparatus for transporting pouches as claimed in claim 1, wherein each of said pack receptacle regions comprises finger means (44, 45) engageable with said pouches, said reciprocating means engaging said finer means.

7. The apparatus for transporting pouches as claimed in claim 6, wherein said pre-conveyor means further includes a first upper and lower wall pair (39, 40) located at said first discharge station, a second upper and lower wall pair (39, 40) located at said second discharge station and a third upper and lower wall pair (37, 38) located at said feed station, a portion of at least the lower wall of said third wall pair extending from said feed station to said first and second discharge stations, the upper and lower walls of said first, second and third wall pairs being spaced from each other a distance sufficient to receive a pouch.

8. The apparatus for transporting pouches as claimed in claim 7, further including means for moving said first and second wall pairs from a first level coincident with the level of said third wall pair to a second level coincident with the level of said discharge conveyor means, said discharge conveyor means comprising a plurality of pockets (25) each for receiving a pouch discharged from a first or second wall pair of said pre-conveyor means, each pocket of said discharge conveyor comprising support legs (26), adjoining side walls (27) and stops (28), the lower wall (40) of said first and second wall pairs being dimensioned to fit between said support legs (26), whereby a pouch is deposited in a pocket (25) when a first wall pair or second wall pair containing a pouch is moved to the level of the discharge conveyor means.

9. The apparatus for transporting pouches as claimed in claim 6, wherein each of said finger means comprises first and second fingers (44, 45) and a cross-web (46) interconnecting said first and second fingers, said reciprocating means comprising holder means (51) including supporting sleeves (47, 48) for holding said finger means, and means (55) for reciprocally driving said holder means along the longitudinal axis of said discharge conveyor means.

10. The apparatus for transporting pouches as claimed in claim 9, further including means for moving each of said finger means in a direction transverse to the longitudinal axis of said discharge conveyor means, whereby said finger means can be removed from their engagement with a pouch.

11. The apparatus for transporting pouches as claimed in claim 10, wherein said means for transverse movement of said finger means comprises a guide roller (56) fixed to the cross-web (46), a guide rail (57, 58) for guiding said guide roller, each guide rail having at least one bearing sleeve (59) mounted to slide on a support journal (60), a support roller (61) mounted to said journal (40), a cam disc (63) with a cam groove (62) receiving said support roller and means for driving said cam disc.

12. The apparatus for transporting pouches as claimed in claim 5, wherein said means for operating comprises sealing means.

13. The apparatus for transporting pouches as claimed in claim 12, wherein said sealing means comprises sealing tong (32) with upper and lower sealing jaw (33, 34).

14. The apparatus for transporting pouches as claimed in claim 13, wherein said means for operating further comprises a folding blade (35).

* * * * *